US009360282B2

(12) United States Patent
Medwell et al.

(10) Patent No.: US 9,360,282 B2
(45) Date of Patent: Jun. 7, 2016

(54) VEHICULAR ARMOUR

(75) Inventors: Roger T. A. Medwell, Coventry (GB); Christopher Davies, Kenilworth (GB); Michael Dalzell, Andover (GB); Mark A. Hopkins-Brown, Tirley (GB)

(73) Assignee: NP Aerospace Limited, Coventry (GB)

( * ) Notice: Subject to any disclaimer, the term of this patent is extended or adjusted under 35 U.S.C. 154(b) by 2085 days.

(21) Appl. No.: 11/999,009

(22) Filed: Apr. 1, 2008

(65) Prior Publication Data

US 2015/0114211 A1 Apr. 30, 2015

(30) Foreign Application Priority Data

Apr. 20, 2007 (GB) ..... 0707751.4

(51) Int. Cl.

| | |
|---|---|
| ***F41H 7/02*** | (2006.01) |
| ***F41H 7/04*** | (2006.01) |
| ***F41H 5/013*** | (2006.01) |
| ***F41H 5/04*** | (2006.01) |

(52) U.S. Cl.

CPC ..... *F41H 7/044* (2013.01); *F41H 5/013* (2013.01); *F41H 5/0428* (2013.01); *F41H 5/0435* (2013.01); *F41H 7/02* (2013.01); *F41H 7/04* (2013.01)

(58) Field of Classification Search

CPC ..... F41H 7/02; F41H 7/04; F41H 7/046; F41H 7/048; F41H 5/20; F41H 5/013; F41H 5/0435; F41H 5/0428

USPC ..... 89/36.08

See application file for complete search history.

(56) References Cited

U.S. PATENT DOCUMENTS

| | | | | |
|---|---|---|---|---|
| 4,594,290 | A * | 6/1986 | Fischer et al. | 428/212 |
| 4,824,495 | A * | 4/1989 | Verneker | 149/7 |
| 4,953,442 | A * | 9/1990 | Bartuski | 89/36.02 |
| 5,560,971 | A * | 10/1996 | Emery | 428/92 |
| 5,705,764 | A * | 1/1998 | Schade et al. | 89/36.02 |
| 6,792,843 | B2 * | 9/2004 | Mohr et al. | 89/36.02 |

FOREIGN PATENT DOCUMENTS

| | | |
|---|---|---|
| EP | 0237095 | 9/1987 |
| EP | 1293429 | 3/2003 |
| GB | 1260111 | 1/1972 |
| GB | 2200437 | 8/1988 |
| WO | WO 03/010484 | 2/2003 |
| WO | WO 2007/015231 | 2/2007 |

* cited by examiner

*Primary Examiner* — Stephen M Johnson

(74) *Attorney, Agent, or Firm* — Kilpatrick Townsend & Stockton LLP; Dean W. Russell

(57) ABSTRACT

Armour for a vehicle comprises ceramic plates (3, 4) with a spall covering (5) on a front surface of the ceramic plate (3), the ceramic plate (4) being bonded at a rear surface thereof to a stiff support plate (2), a plastically deformable layers (9, 10) arranged behind the support plate (2), and spacing means (7) defining a front substantially planar space (11) between the support plate (2) and the plastically deformable layer (9) and a rear substantially planar space (14) arranged to be located between the plastically deformable layer (10) and a vehicle hull (13).

19 Claims, 2 Drawing Sheets

VEHICULAR ARMOUR

This invention relates to armour for a vehicle.

WO 03/010484 describes a ceramic armour system for a vehicle including a ceramic plate comprising alternate layers of different ceramic materials. A front spall layer is bonded to the front surface of the ceramic plate, and a rear shock-absorbing layer is bonded to the rear surface thereof. The assembly may be bolted to the hull of a vehicle with an air gap.

The present invention seeks to provide an armour panel with improved resistance to high-speed fragments of the type capable of penetrating extremely thick steel armour plate.

The invention provides vehicle armour comprising a ceramic plate with a spall covering on a front surface of the ceramic plate, the ceramic plate being bonded at a rear surface thereof to a stiff support plate, a plastically deformable layer arranged behind the support plate, and spacing means defining a front substantially planar space between the support plate and the plastically deformable layer and a rear substantially planar space arranged to be located between the plastically deformable layer and a vehicle hull.

We have found that such a plastically deformable layer can decelerate fragments penetrating the ceramic plate and the support plate.

The ceramic plate may comprise at least two ceramic layers bonded together, for example one layer of ceramic material with good hardness and fracture toughness or good thermal properties and a second layer with good ballistic properties.

The spall covering may be of a thermoplastic material such as polycarbonate and may extend not only over the front surface of the ceramic plate but also over its edges, its rear surface and/or between any ceramic layers from which the ceramic plate is formed.

In one embodiment, the support plate is of a composite material, e.g. comprising carbon or glass.

The ceramic plate may be bonded to the support plate using an elastomeric material, e.g. polyurethane, which may cover all outer surfaces of the ceramic plate with its spall cover.

An embodiment of the invention includes a rear plastically deformable layer arranged behind said plastically deformable layer that is arranged behind the support plate, the spacing means defining an intermediate space between the two plastically deformable layers.

The or each plastically deformable layer can be formed from a multiplicity of laminations. Low-density plastics such as polyethylene are suitable for forming the or each plastically deformable layer.

In embodiments of the invention, at least one of the front, rear and intermediate spaces contain(s) crushable foam such as polyethylene. This helps to ensure that the movement or deformation of the ceramic plate and/or the plastically deformable area is more uniform across the entire protected area.

The invention provides armour of low areal density, e.g. one third to one half that of known steel vehicle armour.

A particular embodiment of the invention will now be described, by way of example only, with reference to the accompanying drawings, in which.

Figure 1:
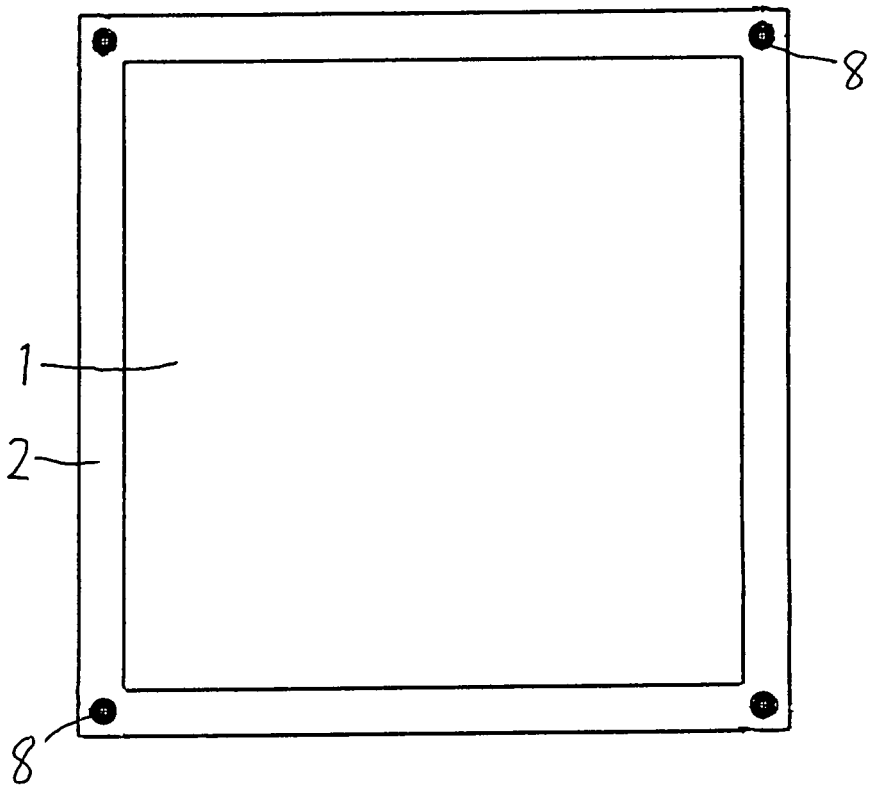
FIG. 1 is a front view of a unit of armour according to the invention.
Figure 2:
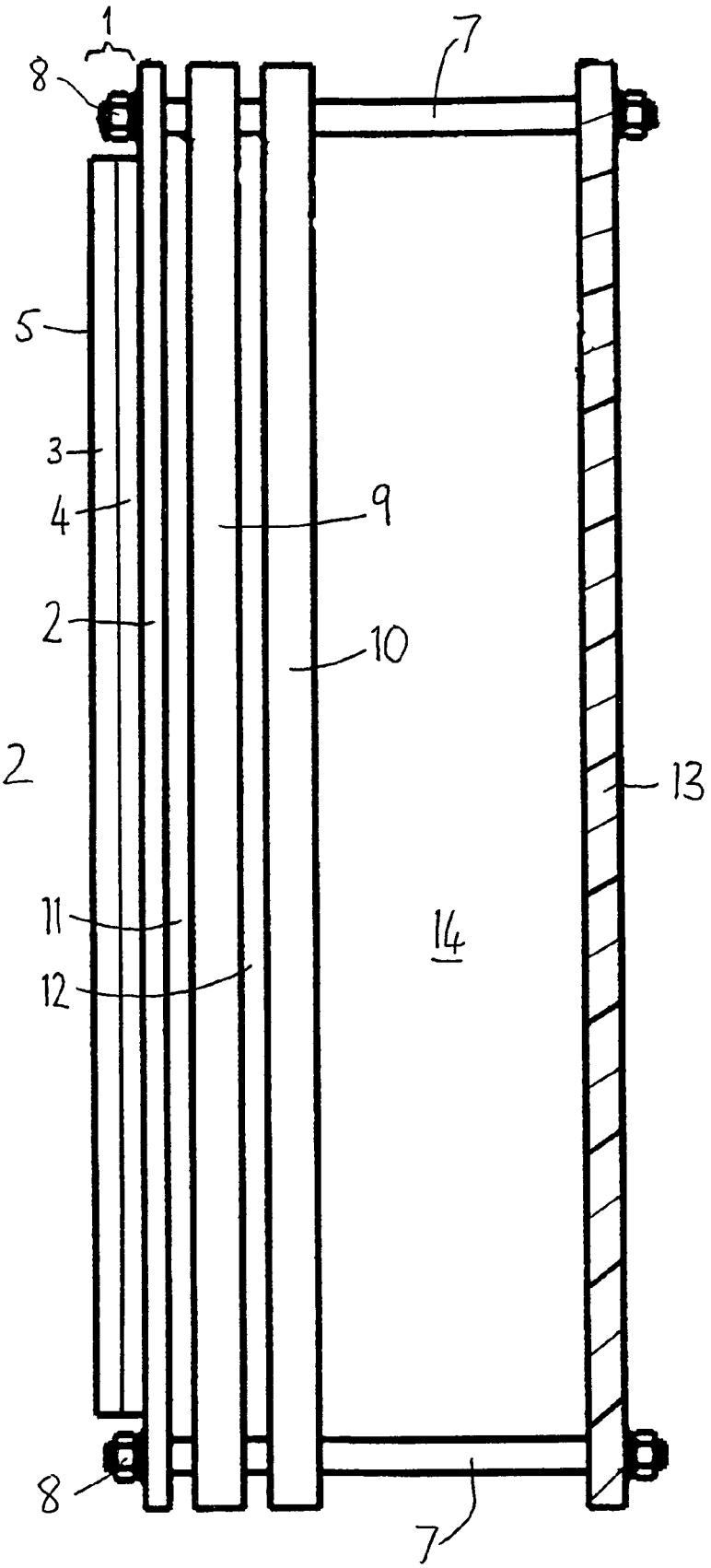
FIG. 2 is a side view of the unit shown in FIG. 1, bolted to a vehicle hull.

The drawings show a square panel comprising a ceramic plate assembly 1 bonded to a support plate 2 of slightly greater area than the assembly 1. The assembly 1 comprises two ceramic plates 3, 4 with a layer of polycarbonate 5 extending around all surfaces of the plates, and is obtainable from Aceram Technologies, Inc. of Kingston, Ontario.

The assembly 1 is bonded to the support plate with an elastomeric, e.g. polyurethane-based adhesive, which may completely surround the assembly 1.

In this example, the support plate 2 is of a carbon fibre/epoxy composite and has holes adjacent each of its corners. Spacing rods 7, e.g. aluminium tubes, extend through the holes, e.g. with a force fit, and the plate 2 is retained on the rods by nuts 8.

The rods 7 also extend through front and rear plastically deformable plates 9, 10. These may be of laminated ultra high molecular weight polyethylene, e.g. "Dyneema"® from DSM Dyneema of Geelen, Netherlands, or another suitable polymer.

The rods maintain a front air gap 11 between support plate 2 and front deformable plate 9 and an intermediate air gap 12 between front deformable plate 9 and rear deformable plate 10. The rods 7 also serve to secure the panel to a vehicle hull 13 (shown in section), with a rear air gap 14 between the rear deformable plate and the hull 13. For example, the front and intermediate gaps may each have a thickness of 10 to 15 mm, whilst the rear air gap is substantially thicker. The rear gap 14 has a thickness allowing the deformable plates 9, 10 to deform and catch the fragments after the assembly 1 and support plate 2 have damaged them. The rear gap thickness could for example be from about 100 mm to about 150 mm. In this regard, a thicker gap increases protection, but there is usually a maximum vehicle width that cannot be exceeded.

The invention claimed is:

1. Armour for a vehicle, the armour comprising a ceramic plate with a spall covering on a front surface of the ceramic plate, the ceramic plate being bonded at a rear surface thereof to a stiff support plate, a plastically deformable layer arranged behind the support plate, and spacing rods for spacing components of the armour, the spacing rods defining a front substantially planar space between the support plate and the plastically deformable layer and a rear substantially planar space arranged to be located between the plastically deformable layer and a vehicle hull.

2. Armour according to claim 1, wherein the ceramic plate comprises at least two ceramic layers bonded together.

3. Armour according to claim 2, wherein the spall covering extends between said ceramic layers.

4. Armour according to claim 1, wherein the spall covering extends over the edges and/or the rear surface of the ceramic plate.

5. Armour according to claim 1, wherein the spall covering is of a thermoplastic material.

6. Armour according to claim 5 in which the thermoplastic material comprises polycarbonate.

7. Armour according to claim 1, wherein the support plate is of a composite material.

8. Armour according to claim 7, wherein the support plate comprises fibres of carbon or glass.

9. Armour according to claim 1, wherein the ceramic plate is bonded to the support plate by an elastomeric material.

10. Armour according to claim 9, wherein said elastomeric material covers all exposed surfaces of the spall covering.

11. Armour according to claim 1, including a rear plastically deformable layer arranged behind said plastically deformable layer that is arranged behind the support plate, the spacing rods defining an intermediate space between the two plastically deformable layers.

12. Armour according to claim 11, wherein the intermediate space contains crushable foam.

13. Armour according to claim 12 in which the crushable foam comprises polyethylene.

14. Armour according to claim 11, wherein each plastically deformable layer is formed from a multiplicity of laminations.

15. Armour according to claim 11, wherein each plastically deformable layer is formed from polyethylene.

16. Armour according to claim 1, wherein the plastically deformable layer is formed from a multiplicity of laminations.

17. Armour according to claim 1, wherein the plastically deformable layer is formed from polyethylene.

18. Armour according to claim 1, wherein the front and/or rear substantially planar spaces contain(s) crushable foam.

19. Armour according to claim 18 in which the crushable foam comprises polyethylene.

* * * * *